US006005210A

United States Patent [19]

Chien

[11] Patent Number: 6,005,210

[45] Date of Patent: Dec. 21, 1999

[54] PUSH BUTTON STYLE SWITCH STRUCTURE

[76] Inventor: Wen-Ching Chien, No. 278-1, Fu-Yung St., Pa-Teh City, Tao-Yuan, Taiwan

[21] Appl. No.: 09/307,554

[22] Filed: May 10, 1999

[51] Int. Cl.[6] ..... H01H 9/02; H01H 19/00

[52] U.S. Cl. ..... 200/438; 200/14; 200/51 R; 200/553; 200/339

[58] Field of Search ..... 200/6 R, 6 C, 200/16 R, 16 D, 51 R, 402, 405, 410, 416, 417, 431, 434, 435, 437, 438, 439, 553, 557, 558, 559, 284, 339; 307/114; 439/502, 505

[56] References Cited

U.S. PATENT DOCUMENTS

| | | | |
|---|---|---|---|
| 2,470,613 | 5/1949 | Gaynor | 200/68 |
| 3,670,121 | 6/1972 | Howe | 200/67 G |
| 3,689,723 | 9/1972 | Ludwig | 200/168 E |
| 4,268,731 | 5/1981 | Kourimsky et al. | 200/67 AA |
| 4,612,423 | 9/1986 | Munroe | 200/16 R |
| 4,924,047 | 5/1990 | Tsuge | 200/553 |
| 5,070,219 | 12/1991 | Grosskrueger et al. | 200/43.008 |
| 5,568,861 | 10/1996 | Lamberti | 200/302.003 |

*Primary Examiner*—Michael Friedhofer
*Attorney, Agent, or Firm*—Bacon & Thomas, PLLC

[57] ABSTRACT

A push button style power switch using a switching button to control movement of a curved sheet to form an electric power on or off state, the power switch is comprised of a base, a power control portion, a switching button and a cover. Wherein the power control portion is provided with a first conducting piece, a second conducting piece and a curved sheet. The conducting pieces connect respectively with two connecting ends of a wire of a power line. The curved sheet is mounted on the first conducting piece. When the switching button is pushed down, it lowers a bottom control tip beneath it to render the tailing end having a small boss of the curved sheet to move down/raise and press/leave the second conducting piece to make electric connection/circuit breaking of the power line. Therefore, this is a power switch structure capable of fast switching.

5 Claims, 7 Drawing Sheets

PUSH BUTTON STYLE SWITCH STRUCTURE

BACKGROUND OF THE INVENTION

1. Field of the Invention

The present invention is related to a push button style power switch structure. And especially is related to a push button style power switch structure using a switching button to control movement of a curved sheet to render a first conducting piece and a second conducting piece to form a power on or off state. In this way, the power switch achieves turning on/off of power.

2. Description of the Prior Art

A conventional power switch as shown in FIGS. 1 to 3 is comprised mainly of a base 10, a electricity conducting set 11, a rotating disk 12 and an upper cover 13. Wherein, a receiving chamber 101 is formed in the base 10, both sides of the receiving chamber 101 are provided each with a dent 102. A hollow column 103 is provided centrally of the receiving chamber 101. The receiving chamber 101 is further provided on both ends thereof with an engaging block 104 and a pressing bar 105 above the engaging block 104. The electricity conducting set 11 is comprised of two fixing sheets 111 opposite longitudinally to each other and a rotation conducting-sheet 112. The fixing sheets 111 are inserted to fix respectively on the exterior sides of the engaging blocks 104 and are provided on the tops thereof each with a piercing portion (with sharpened ends) 113 for extending through and fixing the connecting ends 22 of a power line 20. On one side of each fixing sheet 111 there is an arciform swinging arm 114. The rotation conducting-sheet 112 is slipped over the hollow column 103 and is provided on the opposite ends thereof each with a guiding leaf 115.

The rotating disk 12 is also slipped over the hollow column 103 with a face plate 121 thereof protruding out of the dent 102 of the base 10. A control portion 122 is provided on the bottom of the face plate 121 and is in the form like a windmill. Two blades 123 thereon can be abutted exactly on the inner surfaces of two guiding leaves 115 of the rotation conducting-sheet 112. When the face plate 121 is rotated, the control portion 122 makes the rotation conducting-sheet 112 rotate. And when the guiding leaves 115 are rotated to contact the arciform swinging arms 114 of the fixing sheets 111, the two connecting ends 22 on the two sides of the power line 20 are electrically connected with each other. And electricity transmitting of the two connecting ends 22 can be established together with a normally electrically connected wire 21 of the power line 20 (as shown in FIG. 2).

If the rotating disk 12 keeps on rotating, the two guiding leaves 115 will be separated from the two arciform swinging arms 114 to form circuit breaking (as shown in FIG. 3). And more, the upper cover 13 is provided on the base 10, the two are secured mutually with a bolt 106 and a nut 132. The upper cover 13 is provided on both ends thereof with a notch 131 for extending therethrough the power line 20. When the upper cover 13 is fixed on the base 10, the pressing bars 105 on the base 10 press the power line 20 to enhance stability of the power switch on the power line 20. However, such a power switch structure still has the following disadvantages in practical use although it can get the function of electricity connection or circuit breaking.

1. When rotation of the rotating disk 12 can not render the guiding leaves 115 of the power switch to successfully contact the two arciform swinging arms 114 (or they are separate from each other), control of turning on/off of the circuit is not reliable.
2. In controlling of turning on/off of the circuit, the rotating disk 12 always rotates in the same direction (clockwise); if it happens to rotate in the contrary direction (counterclockwise), the two arciform swinging arms 114 are subjected to deformation or breaking.
3. When in inadvertent contrary direction of the rotating disk 12, the guiding leaves 115 will leave the blades 123 of the rotating disk 12 to make loosening among the members, and the effect expected will not be achieved.
4. When the two connecting ends 22 of the power line 20 are pressed against the piercing portions 113 of the fixing sheets 111, they are subjected to deviation during securing. Displacement renders the piercing portions 113 neither able to successfully make piercing nor to contact with the wires at the pivot connection, thereby it is hard to make electric connection.
5. The base 10 of the power switch presses and clamps the power line 20 by providing the pressing bars 105 thereon. However, the pressing bars 105 on the two ends of the base 10 can not provide the clamping function effectively during use, the power switch is not structurally provided with a device for fixing the connecting ends 22 of a power line 20. Therefore, it is structurally weak, and has the defect of high damage rate.
6. When in switching of the power switch, the guiding leaves 115 and the two arciform swinging arms 114 are subjected to generating sparks, this is because contact or separation of them relies on rotation of the rotating disk 12 which, however, renders the switching of the power switch not fast enough.
7. The upper cover 13 and the base 10 of the power switch are secured mutually with a bolt 106 and a nut 132. While securing not only is too loose at times to result bad conducting, but also is more easily to be overly tight, thereby stripping of threads may occur and securing may fail.

SUMMARY OF THE INVENTION

The push button style power switch of the present invention is comprised mainly of a base, a power control portion, a switching button and a cover. Wherein, the power control portion includes a first conducting piece and a second conducting piece and a curved sheet. The curved sheet is mounted on a support provided on one end of the first conducting piece. The power control portion is provided in a cavity of the base, while the switching button is fixed in two holes provided on two lateral positioning plates. At this time, a control tip on the bottom of the switching button is exactly located in an engaging and controlling groove of the curved sheet. When the power switch is pushed down on one end thereof, the control tip makes the lower free end of the curved sheet raised to form circuit breaking. On the contrary, when the power switch is pushed down on the other end thereof, the free end is lowered to contact the second conducting piece; then the electric power is connected.

The main object of the present invention is toprovide a push button style power switch structure using the switching button to control movement of the curved sheet to form a turning on or off state of electric power. Wherein, the curved sheet is mounted on the support provided on one end of the first conducting piece. Pairs of sharpened ends provided on the first conducting piece and the second conducting piece are used to fix the connecting ends of a wire of a power line in an insertion cavity of the base. Therefore, when the power switch is pushed down on one (or the other) end thereof, the control tip makes the lower free end of the curved sheet raised (lowered) by means of the engaging and controlling groove to form circuit breaking (power connection). This is a power switch structure capable of fast switching and reliable action.

Another object of the present invention is to provide a push button style power switch structure, wherein, the connecting ends of the power line are properly electrically connected with the first and the second conducting pieces. This is mainly achieved by pressing directly of a plurality of pressing bars on the connecting ends of the power line to insert the latter into V shaped grooves in the insertion channel to be pierced through by the pairs of sharpened ends of the conducting pieces. And thus the electric power is reliably connected via the curved sheet.

Another object of the present invention is to provide a push button style power switch structure capable of preventing its cover from loosening and dropping. Wherein, the cavity of the base is provided on the lateral edges thereof with a plurality of engaging grooves for engaging a plurality of engaging lugs. A protrusion is provided on the exterior side of each engaging lug to engage in an engaging hole in each engaging groove to tightly fix the cover on the base.

The present invention will be apparent after reading the detailed description of the preferred embodiment thereof in reference to the accompanying drawings.

BRIEF DESCRIPTION OF THE DRAW

In the drawings:

FIG. 11 is a schematic view showing the state of the power control portion of the present invention when the power is turned on;

DETAILED DESCRIPTION OF THE PREFERRED EMBODIMENT

Figure 1:
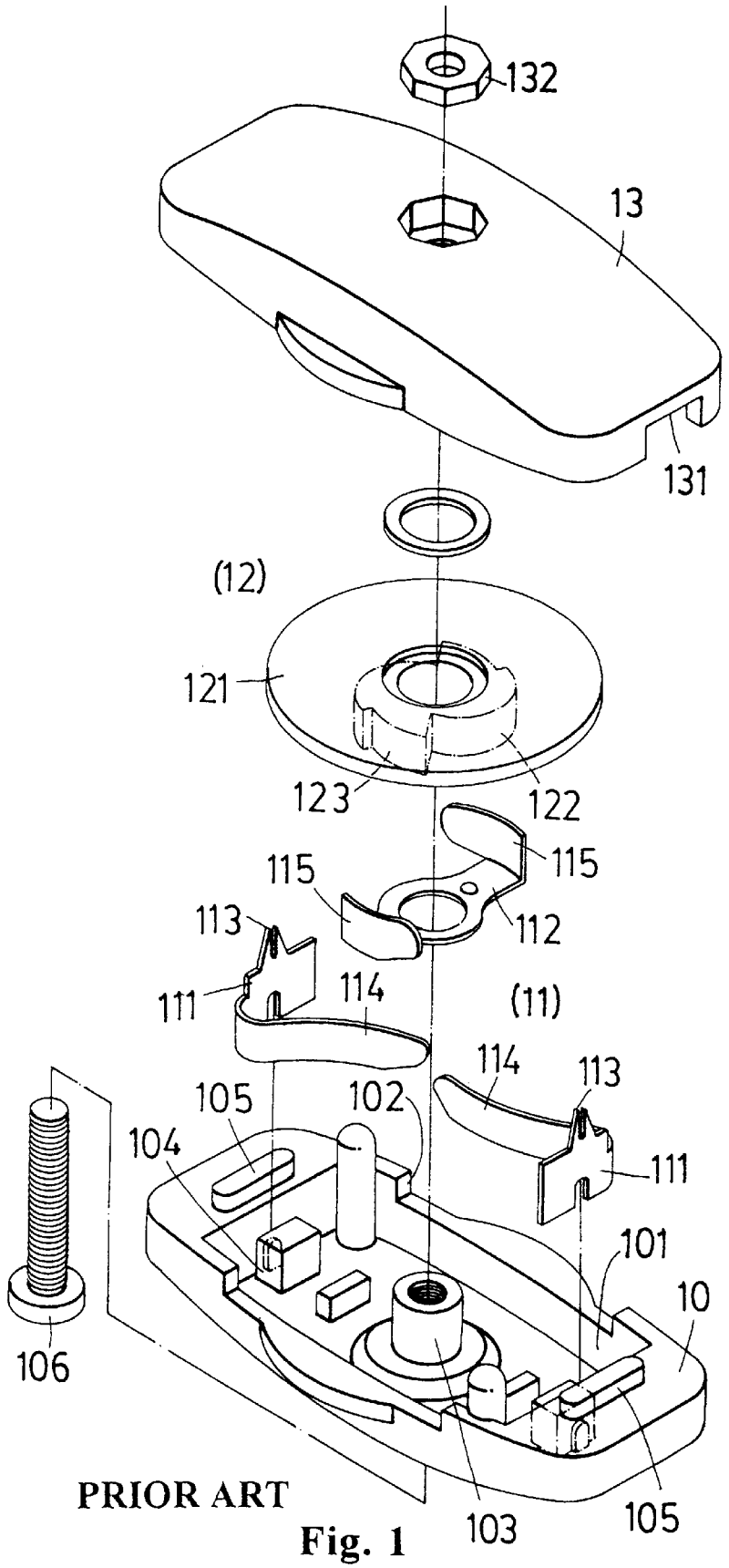
PRIOR ART Fig. 1
FIG. 1 is an analytic perspective view showing a conventional power switch.
Figure 2:
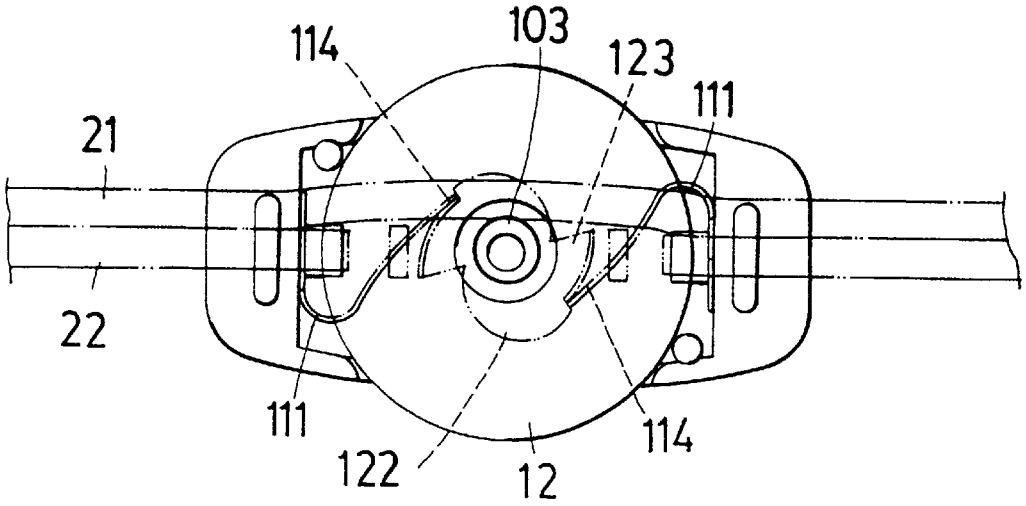
Fig. 2 PRIOR ART
FIG. 2 is a schematic view showing the conducting pieces in an electric connecting state of the circuit of the conventional power switch.
Figure 3:
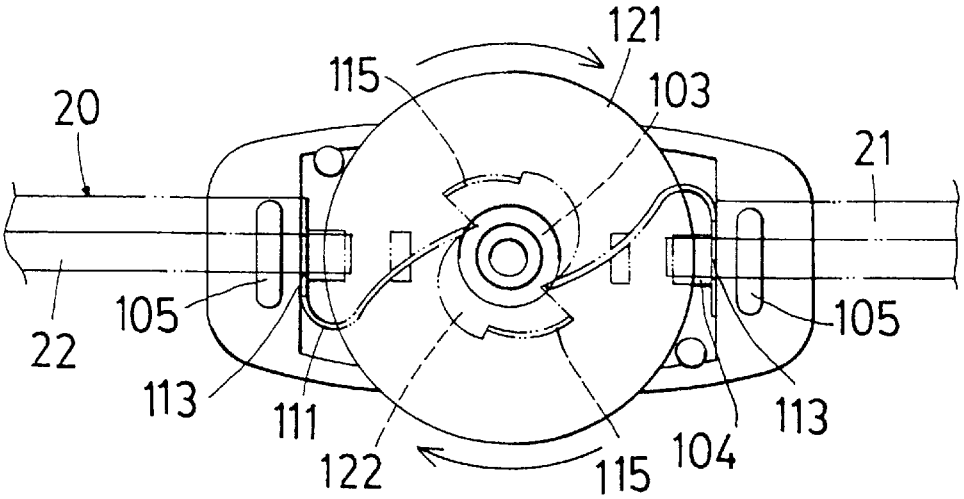
PRIOR ART Fig. 3
FIG. 3 is a schematic view showing the conducting pieces in a circuit breaking state of the conventional power switch.
Figure 4:
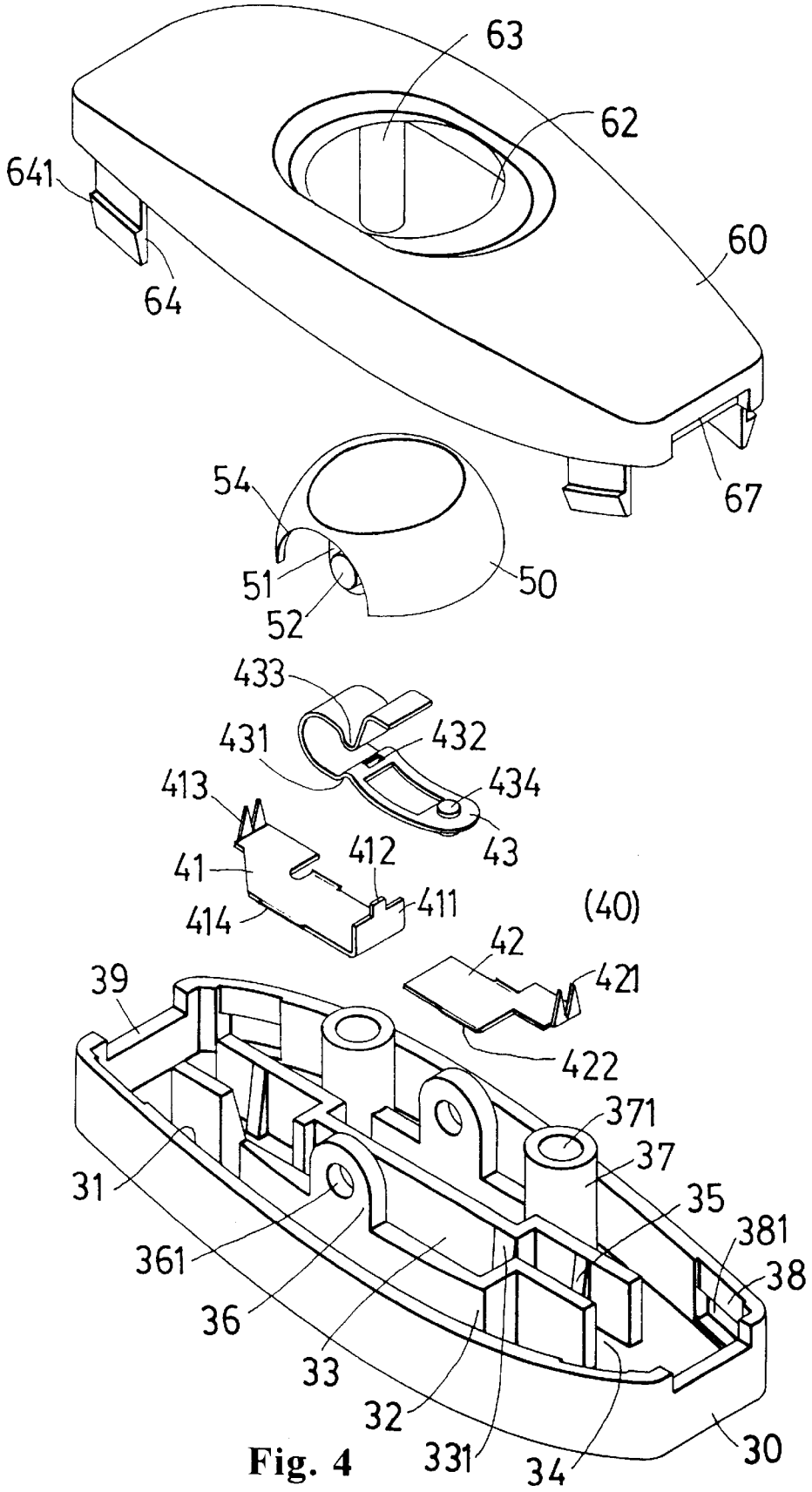
FIG. 4 is an analytic perspective view of the present invention.
Figure 5A:
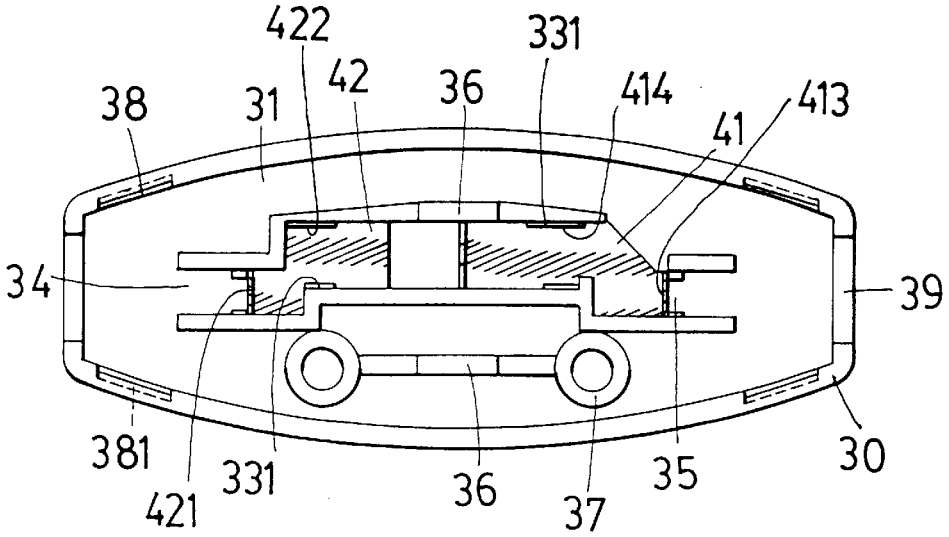
FIG. 5A is a top view of the base of the present invention.
Figure 5B:
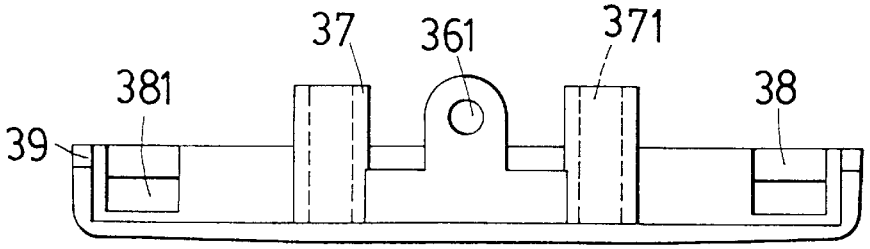
FIG. 5B is a side view of the base of the present invention.

Referring to FIG. 4 which is an analytic perspective view of the present invention, it discloses that the present invention is comprised mainly of a base 30, a power control portion 40, a switching button 50 and a cover 60, wherein:

The base 30 is provided therein a cavity 31 (referring also to FIG. 5A and 5B), the cavity 31 is partitioned with two division plates 32 to form a channel 33. The channel 33 is provided on both ends thereof with a pair of bevel surfaces 331 opposite to each other and inclined downwards and inwards, and an insertion channel 34 neighboring to each pair. The insertion channel 34 is provided therein with a V shaped groove 35 tapered downwardly from above. The two division plates 32 in the cavity 31 are provided at the middles thereof each with a positioning tab 36 extending upwardly and provided with a hole 361. One of the positioning tabs 36 is provided on both sides thereof with a sleeve 37 having a bore 371. The cavity 3l is provided with a plurality of engaging grooves 38 at four corners thereof. An engaging hole 381 is provided on the lower area of each engaging groove 38; and a dent 39 is provided on each end of the cavity 31.

The power control portion 40 is further provided with a first conducting piece 41, a second conducting piece 42 and a curved sheet 43. Wherein, the first conducting piece 41 is press mounted on one end of the channel 33, a free end thereof is bent upwardly to form a support 411 for the curved sheet 43. A positioning protuberance 412 is provided on the top of the support 411. The other free end of the first conducting piece 41 is provided with a pair of sharpened ends 413 perpendicular thereto. A fixing wing 414 is integrally provided on the first conducting piece 41 between the support 411 and the sharpened ends 413 to be press mounted at the bottom between a pair of bevel surfaces 331.

The second conducting piece 42 is press mounted on the other end of the channel 33, a free end thereof is provided with a pair of sharpened ends 421 perpendicular thereto. A fixing wing 422 is provided integrally connected to the sharpened ends 421 to be press mounted at the bottom between another pair of bevel surfaces 331.

The curved sheet 43 is in a C shape, and is provided on the bottom thereof with a recess 431 for mounting of the curved sheet 43 on the support 411. The recess 431 is provided at the middle thereof with a positioning hole 432 for inserting of the positioning protuberance 412. The curved sheet 43 is bent upwardly to form an engaging and controlling groove 433 and is provided on the tailing end thereof with a small boss 434.

Figure 6A:
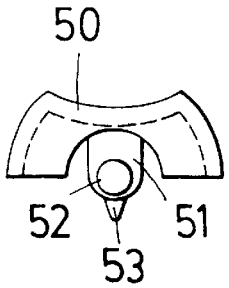
FIG. 6A is a side view of the switching push button of the present invention.
Figure 6B:
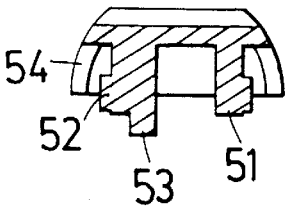
FIG. 6B is another side view of the switching push button of the present invention.

The switching button 50 is fixed between the two positioning tabs 36 in the base 30 and is provided therein with two lateral pendants 51 (as shown in FIGS. 6A and 6B). Two tenons 52 extend outwardly from the lateral pendants 51 for engaging in the two holes 361. One of the two lateral pendants 51 is integrally provided with a control tip 53 being exactly located in the engaging and controlling groove 433 of the curved sheet 43. The switching button 50 is further provided on the lateral sides thereof with two arciform notches 54.

Figure 7A:
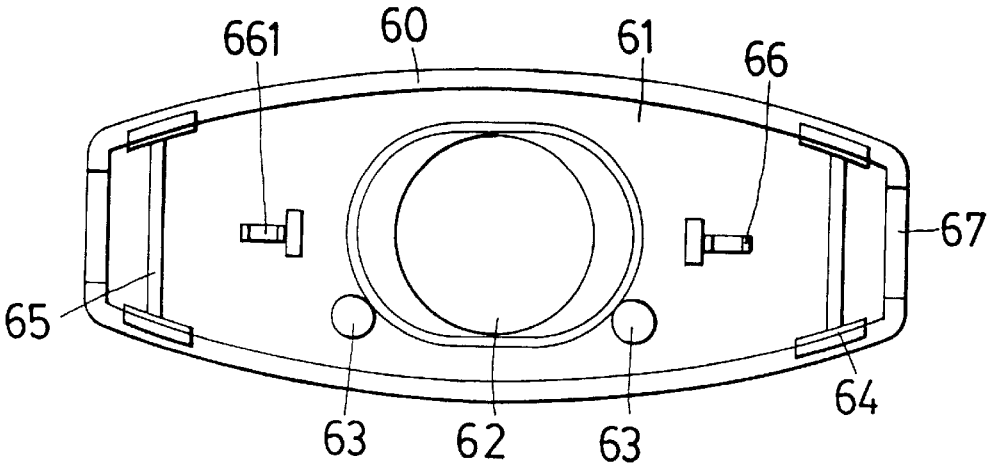
FIG. 7A is a bottom view of the cover of the present invention.
Figure 7B:
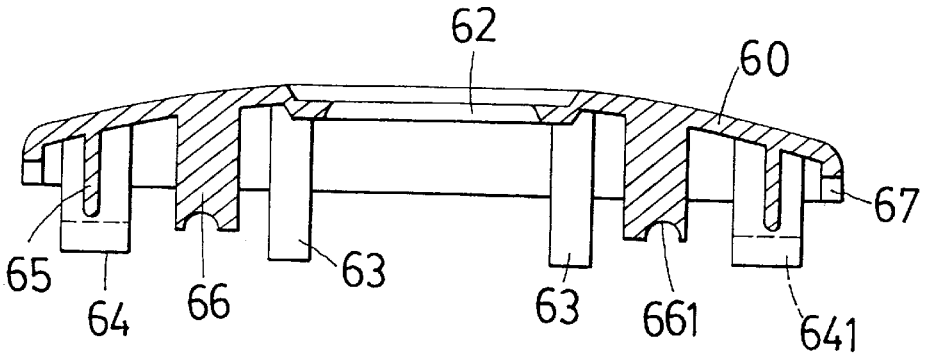
FIG. 7B is a side view of the cover of the present invention.

The cover 60 is put on the base 30 to fixedly cover the latter. A cavity 61 is formed in the cover 60 and is provided centrally with a through hole 62 to allow exposure of the switching button 50. The through hole 62 is provided on the two sides longitudinally thereof with two rods 63 (also referring to FIGS. 7A and 7B). The cavity 61 is provided at the four corners thereof each with an engaging lug 64 having a protrusion 641. Every two engaging lugs 64 opposite to each other laterally are provided therebetween with a pressing plate 65. A "T" shaped pressing bar 66 is provided between each pressing plate 65 and the through hole 62. Each pressing bar 66 is provided on the bottom side thereof with an arciform notch 661, while the cavity 61 is provided on both ends thereof with a notch 67.

When the first conducting piece 41 and the second conducting piece 42 are sequentially placed in the channel 33 of the base 30, they are tightly connected by means of the fixing wings 414, 422 and the bevel surfaces 331 to prevent from loosening and dropping. The sharpened ends 413, 421 of the first conducting piece 41 and the second conducting piece 42 are respectively located inside of the two V shaped grooves 35. The support 411 for the curved sheet 43 on the first conducting piece 41 is located on the centerline of the channel 33. The curved sheet 43 mounted on the support 411 has its small boss 434 moved down to press the second conducting piece 42 to form power connection by pressing of the switching button 50 on one end thereof; or has the small boss 434 moved up to leave the second conducting piece 42 to form circuit breaking by pressing of the switching button 50 on the other end thereof.

Figure 8:
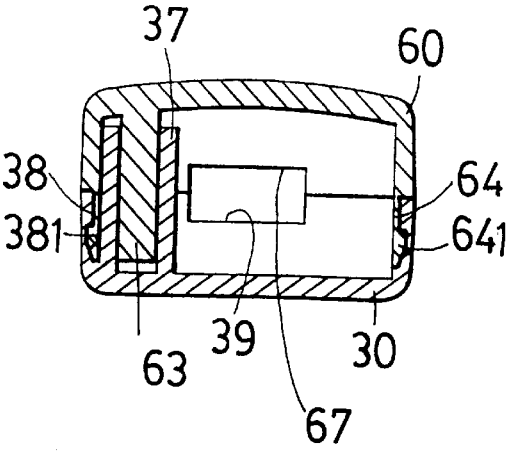
FIG. 8 is a sectional view showing combination of the base and the cover of the present invention.

When the cover 60 is fixed on the base 30, the two rods 63 are inserted respectively into the bores 371 of the sleeves 37. The engaging lugs 64 provided at the four corners of the cavity 61 can be engaged exactly with the engaging grooves 38. While the protrusions 641 of the engaging lugs 64 can be engaged in the engaging holes 381 provided on the lower area of the engaging grooves 38 (referring to FIG. 8), so that the cover 60 can be completely tightly combined with the base 30.

Figure 9A:
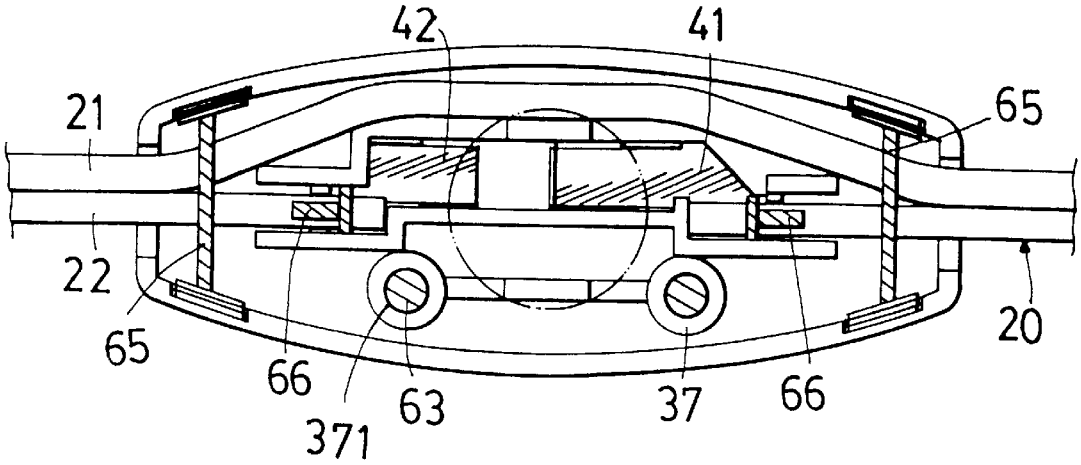
FIG. 9A is a schematic view showing securing of the power line on the base of the present invention.
Figure 9B:
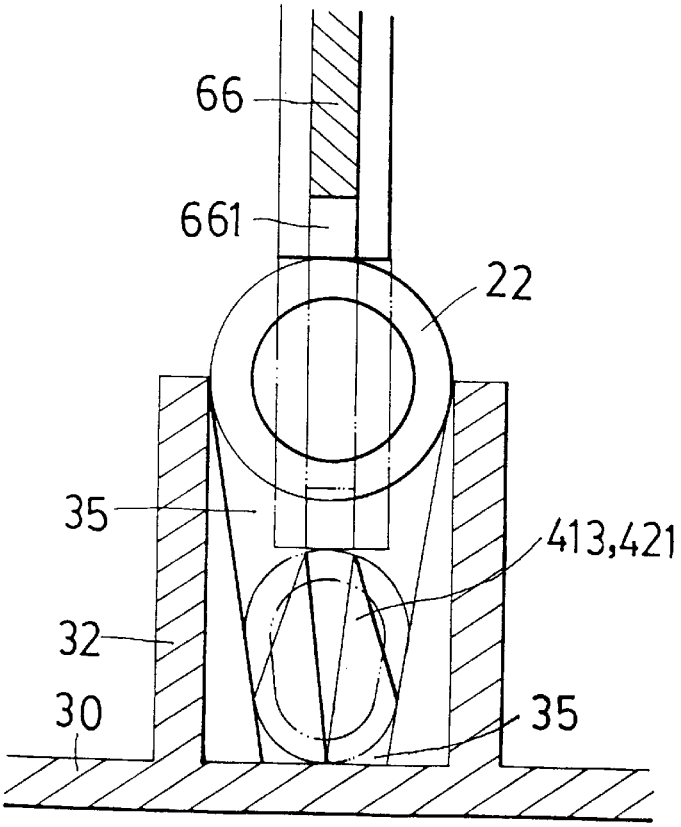
FIG. 9B is a schematic view showing securing of the power line on a V shaped groove of the present invention.

Referring to FIGS. 9A to 12, when the push button style power switch of the present invention is secured on the power line 20, a normally electrically connected wire 21 of the power line 20 is laid outside of a division plate 32. While the connecting ends 22 of the power line 20 are respectively inserted in the two insertion channels 34 (as shown in FIG. 9A). When the connecting ends 22 of a power line 20 are inserted in the two insertion channels 34, they can be pressed into the two V shaped grooves 35 with the pressing bars 66 on the cover 60 (as shown in FIG. 9B). Thereby, the sharpened ends 413, 421 respectively located inside of the two V shaped grooves 35 pierce the connecting ends 22, while the arciform notches 661 of the pressing bars 66 straddle respectively the central areas of the sharpened ends 413, 421. In this way, some other finer power line 20 can also be reliably forced into the two V shaped grooves 35 and is pierced by the sharpened ends 413, 421 to respectively electrically connect with the first conducting piece 41 and the second conducting piece 42.

When the power line 20 is placed between the dents 39 and the notches 67, it is press fixed with the pressing plates 65 inside of the notches 67.

Figure 10:
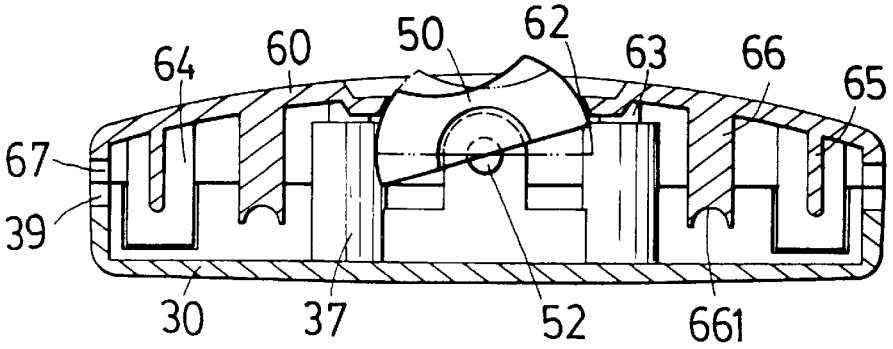
FIG. 10 is a plane view showing combination of the base, the switching push button and the cover of the present invention.
Figure 11:
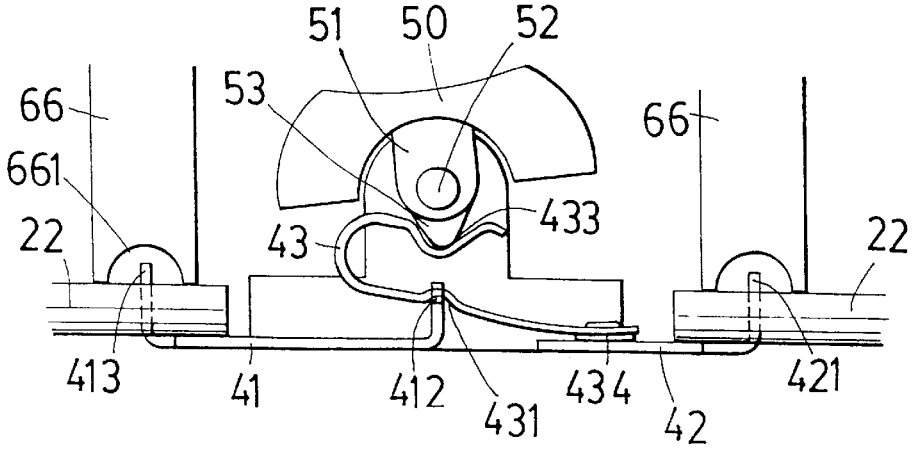

The switching button 50 is fixed between the two positioning tabs 36 in the base 30. The tenons 52 on the switching button 50 extend to engage in the two holes 361, so that the switching button 50 can pivot for switching about the holes 361 (as shown in FIG. 10). When the switching button 50 is pushed on the left end thereof, the bottom control tip 53 exerts force to render the tailing end having the small boss 434 of the curved sheet 43 to move down. So that the small boss 434 contacts the second conducting piece 42 to make electric connection between the first conducting piece 41 and the second conducting piece 42, thus the two connecting ends 22 of the power line 20 are electrically connected with each other (as shown in FIG. 11).

Figure 12:
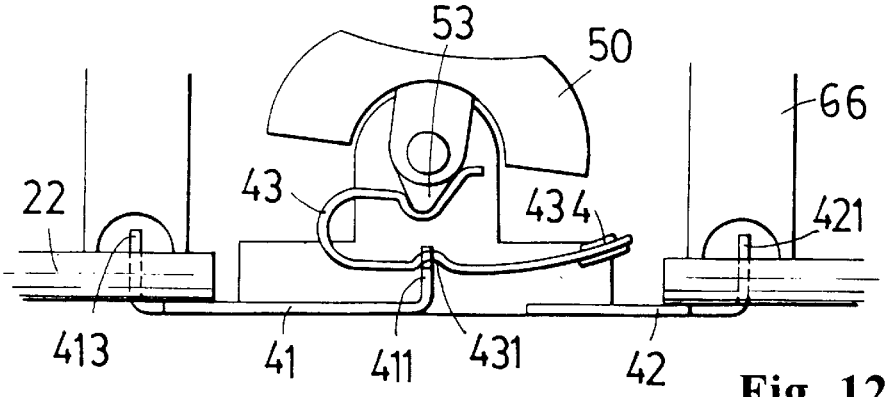
FIG. 12 is a schematic view showing the state of the power control portion of the present invention when the power is turned off.

On the contrary, when the switching button 50 is pushed on the right end thereof, the bottom control tip 53 exerts force to render the tailing end having the small boss 434 of the curved sheet 43 to move up. So that the small boss 434 leaves the second conducting piece 42 to make circuit breaking between the first conducting piece 41 and the second conducting piece 42, thus the two connecting ends 22 of the power line 20 are electrically separated from each other (as shown in FIG. 12).

According to the above statements, it can be found that the push button style power switch of the present invention has the following advantages:

1. The first conducting piece 41 and the second conducting piece 42 can be reliably fixed by means of tight contact of the bevel surfaces 331 with the fixing wings 414 and 422.
2. The V shaped grooves 35 are tapered downwardly from above. Such design can not only afford power lines 20 of various sectional areas, but also allow piercing of every power line 20 by the sharpened ends 413, 421 to assure electric connection between the first conducting piece 41 and the second conducting piece 42.
3. The power line 20 placed in the insertion channel 34 is pressed tight by the pressing bars 66 on the cover 60. Thereby the sharpened ends 413, 421 can certainly extend into the power line 20 to effectively prevent the latter from slipping which makes circuit breaking between the first conducting piece 41 and the second conducting piece 42. The arciform notches 661 on the bottom side of the pressing bars 66 can make further certainty of pressing tight on a finer power line 20.
4. The cover 60 is secured by combination of the engaging lugs 64 with the engaging grooves 38. The protrusions 641 of the engaging lugs 64 can be engaged in the engaging holes 381 provided on the lower area of the engaging grooves 38, so that the cover 60 can be completely tightly combined with the base 30.
5. Moving up and down of the small boss 434 of the curved sheet 43 is controlled by the control tip 53 of the switching button 50 to get the object of fast switching, and preventing from generation of sparks. This can increase safety.

In conclusion, the power switch of the present invention completely meets the conditions of industrial utility, novelty, and improvement.

Having thus described my invention, what I claim as new and desire to be secured by Letters Patent of the United States is:

1. A push button style power switch being connected to a power line which includes a normally electrically connected wire and another wire separated into two connecting ends being electrically connected to each other by switching of said power switch or being kept separated in a state of circuit breaking, said power switch is comprised of:

a base being provided therein a cavity which is partitioned to form a channel, said channel is provided on both ends thereof with an insertion channel; said cavity is provided at the middle thereof with a plurality of positioning tabs provided each with a hole, and is provided with a plurality of engaging grooves at four corners thereof; and a dent is provided on each end of said cavity;

a power control portion being provided with a first conducting piece, a second conducting piece and a curved sheet, wherein: said first conducting piece is press mounted on one end of said ends of said channel, a free end thereof is bent upwardly to form a support for said curved sheet, a positioning protuberance is provided on the top of said support, an other free end of said first conducting piece is provided with a pair of sharpened ends perpendicular thereto; said second conducting piece is press mounted on the other end of said ends of said channel, a free end thereof is provided with a pair of sharpened ends perpendicular thereto; said curved sheet is in a C shape, and is provided on the bottom thereof with a recess for mounting of said curved sheet on said support, said recess is provided at the middle thereof with a positioning hole for inserting of said positioning protuberance, said curved sheet is bent upwardly to form an engaging and controlling groove and is provided on a tailing end thereof with a small boss;

a switching button being fixed between said positioning tabs in said base, said switching button is provided on lateral sides thereof with two arciform notches and is further provided therein with two lateral pendants, two tenons extend outwardly from said lateral pendants for engaging in said holes on said positioning tabs, one of said two lateral pendants is integrally provided with a control tip being exactly located in said engaging and controlling groove of said curved sheet;

a cover, a cavity is formed in said cover and is provided centrally with a through hole to allow exposing of said switching button, said cavity is provided at four corners thereof each with an engaging lug, every two of the engaging lugs opposite to each other laterally are provided therebetween with a pressing plate, a pressing bar is provided between each of the pressing plates and said through hole, said cavity is provided on the both ends thereof with a notch;

said connecting ends of said power line are respectively inserted and fixed in said two insertion channels, and are pierced by said sharpened ends to respectively connect with said first conducting piece and said second conducting piece; said first conducting piece is electrically connected with or separated from said second conducting piece by operation of said curved sheet of which said small boss is lowered or raised by controlling of said control tip moved by pressing either of two ends of said switching button to switch on/off electric power.

2. A push button style power switch as in claim 1, wherein, said channel in said cavity is provided on the both ends thereof with a pair of bevel surfaces opposite to each other and inclined downwards and inwards; a fixing wing is integrally provided on said first conducting piece between said support and said sharpened ends of said first conducting piece to be press mounted at the bottom between a pair of said pair of bevel surfaces, and another fixing wing is provided integrally connected to said sharpened ends of said second conducting piece to be press mounted at the bottom between another of the pair of bevel surfaces to increase reliability of said two conducting pieces.

3. A push button style power switch as in claim 1, wherein, said cavity of said base is provided on the both sides thereof with a sleeve having a bore, and said cavity of said cover is provided therein with two rods insertable into said bores, and said cover is press fixed on said base fast and accurately.

4. A push button style power switch as in claim 1, wherein, said insertion channels in said base each are provided therein with a V shaped groove tapered downwardly from above.

5. A push button style power switch as in claim 1, wherein, said engaging grooves in said cavity of said base each are provided therein with an engaging hole on a lower area thereof, and said engaging lugs of said cover are provided with protrusions being engaging in said engaging holes, so that said cover can be completely tightly combined with said base.

* * * * *